US006551193B1

(12) United States Patent
Edwards

(10) Patent No.: US 6,551,193 B1
(45) Date of Patent: Apr. 22, 2003

(54) WATER FOWL TOY

(76) Inventor: Albert C. Edwards, 2748 Irving Rd., Thaxton, VA (US) 24174

( * ) Notice: Subject to any disclaimer, the term of this patent is extended or adjusted under 35 U.S.C. 154(b) by 0 days.

(21) Appl. No.: 10/107,128

(22) Filed: Mar. 28, 2002

(51) Int. Cl.[7] ..... A63H 23/10
(52) U.S. Cl. ..... 472/128; 472/134; 441/130; 446/153
(58) Field of Search ..... 472/128, 129, 472/134; 441/65, 130, 131, 66; 446/153

(56) References Cited

U.S. PATENT DOCUMENTS 1,851,768 A * 3/1932 Hubbell ..... 472/129
2,404,729 A * 7/1946 Hurt ..... 472/129
2,688,207 A * 9/1954 Hurt ..... 472/129
4,302,003 A * 11/1981 Hughes ..... 472/129
4,763,895 A * 8/1988 Tepper ..... 472/101
4,962,921 A * 10/1990 Simmons ..... 472/129
5,135,440 A * 8/1992 Smollar et al. ..... 472/128
5,299,588 A * 4/1994 MacLeod ..... 135/16
6,027,393 A * 2/2000 O'Rourke ..... 446/153

* cited by examiner

*Primary Examiner*—Kien T. Nguyen

(57) ABSTRACT

A water fowl toy for providing a humorous and entertaining gag for the user. The water fowl toy includes a water fowl-shaped structure having a body, a neck, a head, and a tubular tail, and being adapted to hold water therein with the tubular tail being integrally attached to the body and having an open end and with the water fowl-shaped structure also having a passageway extending therethrough from the open end of the tubular tail through the body, the neck, and into the head.

3 Claims, 3 Drawing Sheets

WATER FOWL TOY

BACKGROUND OF THE INVENTION

1. Field of the Invention

The present invention relates to water shooting toys and more particularly pertains to a new water fowl toy for providing a humorous and entertaining gag for the user.

2. Description of the Prior Art

The use of water shooting toys is known in the prior art. More specifically, water shooting toys heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 1,359,342; 1,504,186; U.S. Pat. No. Des. 295,995; U.S. Pat. No. Des. 390,425; U.S. Pat. No. 4,073,397; and U.S. Pat. No. Des. 186,610.

While these devices fulfill their respective, particular objectives and requirements, the aforementioned patents do not disclose a new water fowl toy. The prior art describes inventions having bird-shaped structures with bodies, necks, heads, and tails, and with a passageway extending therethrough to allow water to pass out of the snout of the bird-shaped structure.

SUMMARY OF THE INVENTION

The general purpose of the present invention, which will be described subsequently in greater detail, is to provide a new water fowl toy which has many of the advantages of the water shooting toys mentioned heretofore and many novel features that result in a new water fowl toy which is not anticipated, rendered obvious, suggested, or even implied by any of the prior art water shooting toys, either alone or in any combination thereof. The present invention includes a water fowl-shaped structure having a body, a neck, a head, and a tubular tail, and being adapted to hold water therein with the tubular tail being integrally attached to the body and having an open end and with the water fowl-shaped structure also having a passageway extending therethrough from the open end of the tubular tail through the body, the neck, and into the head.

There has thus been outlined, rather broadly, the more important features of the water fowl toy in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new water fowl toy which has many of the advantages of the water shooting toys mentioned heretofore and many novel features that result in a new water fowl toy which is not anticipated, rendered obvious, suggested, or even implied by any of the prior art water shooting toys, either alone or in any combination thereof.

Still another object of the present invention is to provide a new water fowl toy for providing a humorous and entertaining gag for the user.

Still yet another object of the present invention is to provide a new water fowl toy that is easy and convenient to use for entertainment purposes.

Even still another object of the present invention is to provide a new water fowl toy that makes the user think he/she is shooting water towards someone else when, instead, water is backfired upon the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
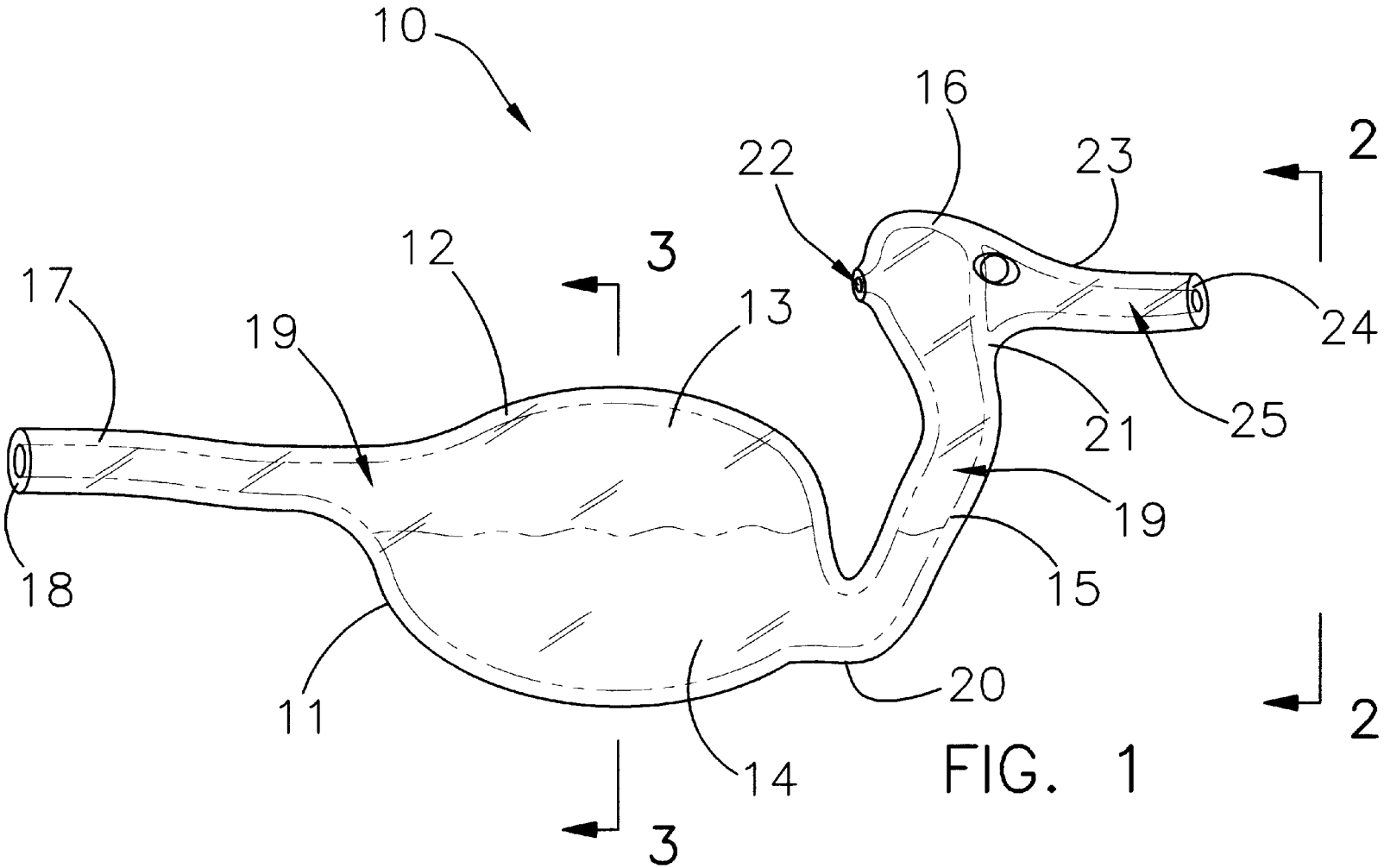
FIG. 1 is a side elevational view of a new water fowl toy according to the present invention.
Figure 2:
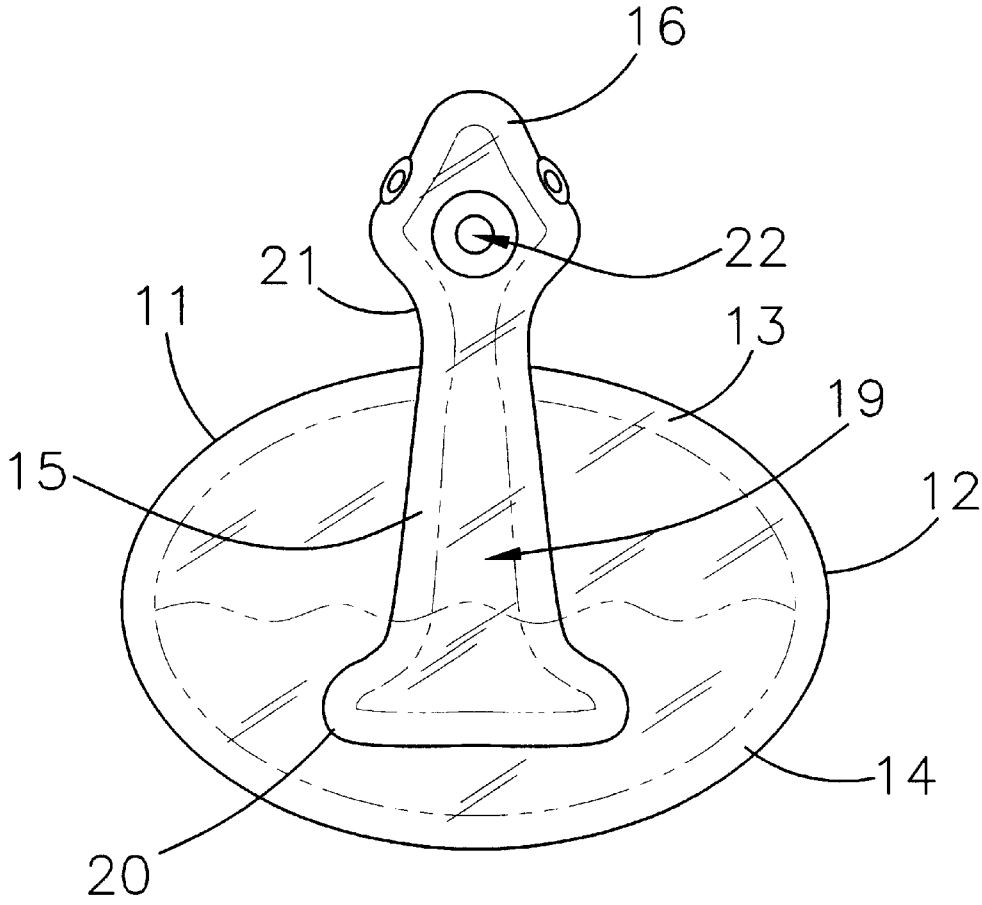
FIG. 2 is a front elevational view of the present invention.
Figure 3:
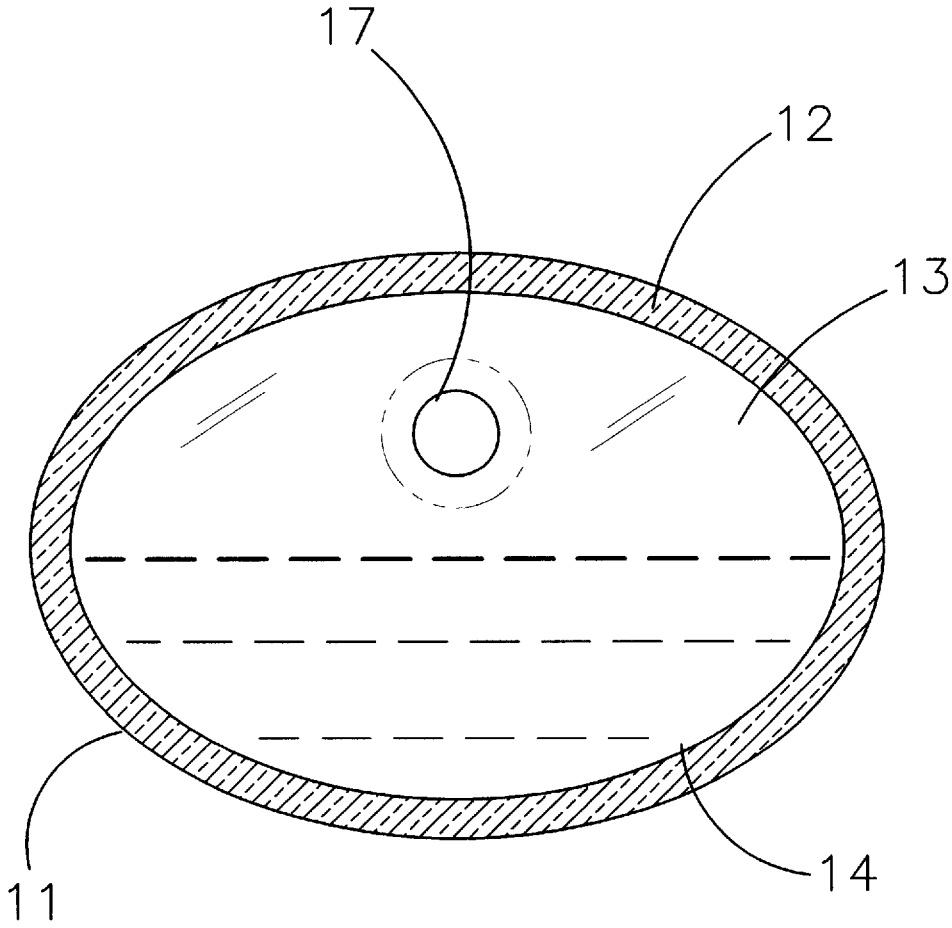
FIG. 3 is lateral cross-sectional view of the present invention.

With reference now to the drawings, and in particular to FIGS. 1 through 3 thereof, a new water fowl toy embodying the principles and concepts of the present invention and generally designated by the reference numeral 10 will be described.

As best illustrated in FIGS. 1 through 3, the water fowl toy 10 generally comprises a water fowl-shaped structure 11 having a body 12, a neck 15, a head 16, and a tubular tail 17, and being adapted to hold water therein. The tubular tail 17 is integrally attached to the body 12 and has an open end 18. The water fowl-shaped structure 11 also has a passageway 19 extending therethrough from the open end 18 of the tubular tail 17 through the body 12, the neck 15, and into the head 16. The water-fowl-shaped structure 11 is shaped like a duck and is made of a rigid, transparent plastic material. The body 12 is adapted to hold water therein and has a pot-bellied lower portion 14 and also has an upper portion 13. The neck 15 has a bottom end 20 which is integrally attached to the pot-bellied lower portion 14 of the body 12, and also extends upwardly relative to the body 12. The head 16 is integrally attached to a top end 21 of the neck 15, and has a forward-extending snout 23 which has an open end 24 and a bore 25 extending therein through the open end 24. The head 16 has a hole 22 extending through a back portion thereof and into the passageway 19 and through which water is dispensed upon a user blowing water from the pot-bellied portion 14 of the body 12 through the neck 15 and out of the head 16. The open end 18 of the tubular tail 17 is a mouthpiece for the user to blow air into, thus urging water contained in the pot-bellied lower portion 14 of the body 12 though the neck 15 and out of the head 16 through the hole 22. The tubular tail 17 extends outwardly from the upper portion 13 of the body 12.

In use, the user puts water inside the body 12 of the fowl-shaped structure 11 through the open end 18 of the tubular tail 17, and places one's mouth over the open end 18 of the tubular tail 17 and blows air into the tubular tail 17 which forces the water contained in the body 12 through the neck 15 and into the head 16, and through the hole 22 and back upon the user rather than through the open end 24 of the forward-extending snout 23.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the water fowl toy. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water fowl toy comprising:

a water fowl-shaped structure having a body, a neck, a head, and a tubular tail, and being adapted to hold water therein, said tubular tail being integrally attached to said body and having an open end, said water fowl-shaped structure also having a passageway extending therethrough from said open end of said tubular tail through said body, said neck, and into said head; said water-fowl-shaped structure being shaped like a duck and being made of a rigid, transparent plastic material, said body being adapted to hold water therein and having a pot-bellied lower portion and also having an upper portion; said neck having a bottom end which is integrally attached to said pot-bellied lower portion, and also extending upwardly relative to said body; said head being integrally attached to a top end of said neck, and having a forward-extending snout which as an open end and a bore extending therein through said open end; said head having a hole extending through a back portion thereof and into said passageway and through which water is dispensed upon a user blowing water from said pot-bellied portion of said body through said neck and out of said head.

2. A water fowl toy as described in claim 1, wherein said open end of said tubular tail is a mouthpiece for the user to blow air into thus urging water contained in said pot-bellied lower portion of said body through said neck and out of said head through said hole.

3. A water fowl toy as described in claim 2, wherein said tubular tail extending outwardly from said upper portion of said body.

* * * * *